US005337038A

United States Patent [19]

Taniguchi et al.

[11] Patent Number: 5,337,038

[45] Date of Patent: Aug. 9, 1994

[54] PTC THERMISTOR

[75] Inventors: Masaaki Taniguchi; Keitsugu Nohara, both of Akita; Nobuo Kaihara, Honjo, all of Japan

[73] Assignee: TDK Corporation, Japan

[21] Appl. No.: 72,318

[22] Filed: Jun. 3, 1993

[30] Foreign Application Priority Data

Jun. 11, 1992 [JP] Japan ..... 4-152184

[51] Int. Cl.[5] ..... H01C 7/10

[52] U.S. Cl. ..... 338/22 R; 338/22 SD

[58] Field of Search ..... 338/22 R, 22 SD

[56] References Cited

U.S. PATENT DOCUMENTS 4,232,214 11/1980 Shioi et al. ..... 338/22 R X
5,210,516 5/1993 Shikama et al. ..... 338/22 R

FOREIGN PATENT DOCUMENTS 49-8379 2/1974 Japan .
49-54889 5/1974 Japan .
53-118759 10/1978 Japan .
57-148302 9/1982 Japan .
58-49601 11/1983 Japan .
1236602 9/1989 Japan .
2305404 12/1990 Japan .

*Primary Examiner*—Marvin M. Lateef
*Attorney, Agent, or Firm*—Lerner, David, Littenberg, Krumholz & Mentlik

[57] ABSTRACT

A PTC thermistor capable of ensuring ohmic contact between a PTC thermistor body and an electrode and preventing deterioration in appearance of the thermistor to increase the yields. The PTC thermistor includes a PTC thermistor body, a first electrode formed of plated Ni of 0.2 to 0.7 μm in thickness and a second electrode arranged on the first electrode and mainly formed of metal of low contact resistance. Moisture or water such as a Ni plating solution enters into the PTC thermistor body during formation of the first electrode on the body. The water then bursts due to expansion during baking of the second electrode formed on the first electrode, to produce craters on a surface of the second electrode. A decrease in thickness of the first electrode to a level as small as 0.2 to 0.7 μm facilitates outward discharge of the water to reduce occurrence of the craters.

11 Claims, 2 Drawing Sheets

PTC THERMISTOR

BACKGROUND OF THE INVENTION

This invention relates to a positive temperature coefficient thermistor (hereinafter referred to as "PTC thermistor"), and more particularly to an electrode structure of a PTC thermistor.

Conventionally, electroless Ni plating has been typically employed for forming an ohmic electrode on a PTC thermistor body of a PTC thermistor. A thickness of a Ni film formed by electroless Ni plating is required to be typically as large as 1 μm or more and more particularly 1.0 to 5.0 μm in order to establish satisfactory ohmic contact.

Also, the Ni film formed by electroless Ni plating causes an increase in contact resistance of the PTC thermistor and deterioration of the ohmic electrode with time due to oxidation when it is solely used for the purpose of forming the ohmic electrode. In order to avoid the disadvantage, a paste of Ag which is metal of low contact resistance is applied to the plated Ni film, resulting in forming a multi-electrode structure.

More particularly, the conventional multi-electrode structure for the PTC thermistor is formed by subjecting the Ag paste applied onto the plated Ni film to baking at about 500° C. Unfortunately, the baking causes moisture in the thermistor body originating in a plating solution or the like to expand and burst, resulting in a number of micro-craters being formed in the plated Ni film. This leads to deterioration in appearance of the PTC thermistor to decrease the yields.

Further, in the conventional PTC thermistor, the Ni film formed by electroless Ni plating has a thickness as large as 1 μm or more, so that a length of time required for the plating is disadvantageously increased. Also, this requires to use a plating equipment of an increased plating capacity and causes the amount of plating material used to be increased, leading to an increasing in manufacturing cost of the PTC thermistor:

Moreover, when a thickness of the plated Ni film is 2 μm or more, the conventional PTC thermistor tends to fail to pass a Ni peeling test for determining resistance to peeling between Ni and Ag due to micro-craters in the plated Ni film. The Ni peeling test is generally carried out in a manner to apply an adhesive tape to a sample of a Ni film and then peel the tape from the sample to possibly form craters in the sample, resulting in evaluating or determining the craters.

SUMMARY OF THE INVENTION

The present invention has been made in view of the foregoing disadvantage of the prior art.

Accordingly, it is an object of the present invention to provide a PTC thermistor which is capable of establishing satisfactory ohmic contact between a PTC thermistor body and an electrode.

It is another object of the present invention to provide a PTC thermistor which is capable of increasing yields of the PTC thermistor while providing it with a good appearance.

In accordance with one aspect of the present invention, a PTC thermistor is provided. The PTC thermistor includes a PTC thermistor body, a first electrode arranged on the PTC thermistor body and formed of Ni with a thickness of 0.2 to 0.7 μm by plating, and a second electrode arranged on the first electrode and formed of metal of low contact resistance. The metal of low contact resistance mainly consists of Ag.

In the PTC thermistor of the present invention constructed as described above, formation of the first electrode on the PTC thermistor body causes water originating in a Ni plating solution or the like to enter the PTC thermistor. Therefore, when the second electrode formed on the first electrode is baking, water in the PTC thermistor body bursts due to thermal expansion to form burst marks or craters on a surface of the first electrode. Formation of the first electrode with a thickness as small as 0.2 to 0.7 μm restrains a sealing action of the Ni film which is the first electrode. More particularly, the thickness permits the water in the PTC thermistor body to be easily discharged through the Ni film, to thereby minimize formation of craters. This leads to satisfactory ohmic contact between the PTC thermistor body and the electrode, to thereby increase yields of the PTC thermistor while providing it with a good appearance.

In a preferred embodiment of the present invention, the second electrode is formed by baking carried out at a temperature of 500° C. or less. The baking at such a temperature further improves yields of the PTC thermistors.

In a preferred embodiment of the present invention, the second electrode is formed of a composition of Ag powder and frit selected from the group consisting of lead borosilicate glass and soda-lime glass.

In accordance with another aspect of the present invention, a process for manufacturing a PTC thermistor is provided. The process comprises the steps of providing a PTC thermistor body, depositing Ni of 0.2 to 0.7 μm in thickness on a surface of the PTC thermistor body by plating to form a first electrode thereon, and depositing metal of low contact resistance on the first electrode to form a second electrode thereon.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a PTC thermistor and its manufacturing process according to the present invention will be described hereinafter with reference to the accompanying drawings.

Figure 1:
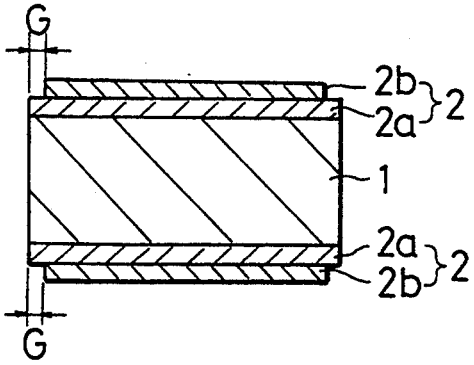
FIG. 1 is a sectional view showing an embodiment of a PTC thermistor according to the present invention.

Referring first to FIG. 1, an embodiment of a PTC thermistor according to the present invention is illustrated. Generally speaking, a PTC thermistor of the illustrated embodiment includes a PTC thermistor body 1 and electrodes 2 formed on upper and lower surfaces of the thermistor body 1.

The PTC thermistor body 1 is made of a semiconductor porcelain material mainly consisting of $BaTiO_3$ and having positive resistance-temperature characteristics. The PTC thermistor body 1 may be formed into, for example, a disc-like shape of 18 mm in diameter and 2.5 mm in thickness.

The electrodes 2 are constructed into a multi-electrode structure. More particularly, the electrodes 2 include a first electrode 2*a* formed on each of the upper and lower surfaces of the PTC thermistor body 1 and a second electrode 2*b* formed on the first electrode 2*a*.

The first electrode 2*a* is provided on each of the upper and lower surfaces of the PTC thermistor body 1 by electroless Ni plating and comprises a plated Ni film having a thickness as small as 0.2 to 0.7 μm and preferably 0.4 to 0.6 μm. In the illustrated embodiment, the Ni plating is carried out using a Ni-P alloy material which provides a plated film containing about 90% of Ni and about 5 to 12% of P. The thickness below 0.2 μm causes occurrence of unevenness of the plating to be increased and the thickness above 0.7 μm tends to cause craters to be produced in the Ni film as described hereinafter.

The second electrode 2*b* may comprise a film or layer of Ag which is metal of low contact resistance. The layer may be formed into a thickness of 3 to 7 μm.

The Ag film for the second electrode 2 may be formed using an Ag paste material. Ag paste used for this purpose may have such a composition as shown in Table 1.

TABLE I

| Composition of Ag Paste | |
|---|---|
| Ag Powder | 100 parts by weight |
| Spherical powder (particle size: 0.1 μm or less) | 67.9 parts by weight |
| Spherical powder* (particle size: 2 to 3 μm) | 3 parts by weight |
| Flake powder | 29.1 parts by weight |
| Frit (lead borosilicate glass) (or soda-lime glass) | 5 parts by weight |
| Vehicle | 47 parts by weight |
| Binder (ethyl cellulose alkyd resin) | |
| Solvent (butyl carbitol) | |

*The spherical powder provides a surface of the electrode formed by baking with smoothness.

The Ag paste contains finely divided spherical powders (particle size of 0.1 μm or less) and low melting glass, resulting in forming an Ag film of satisfactory compactness and adherent characteristics.

Figure 2:
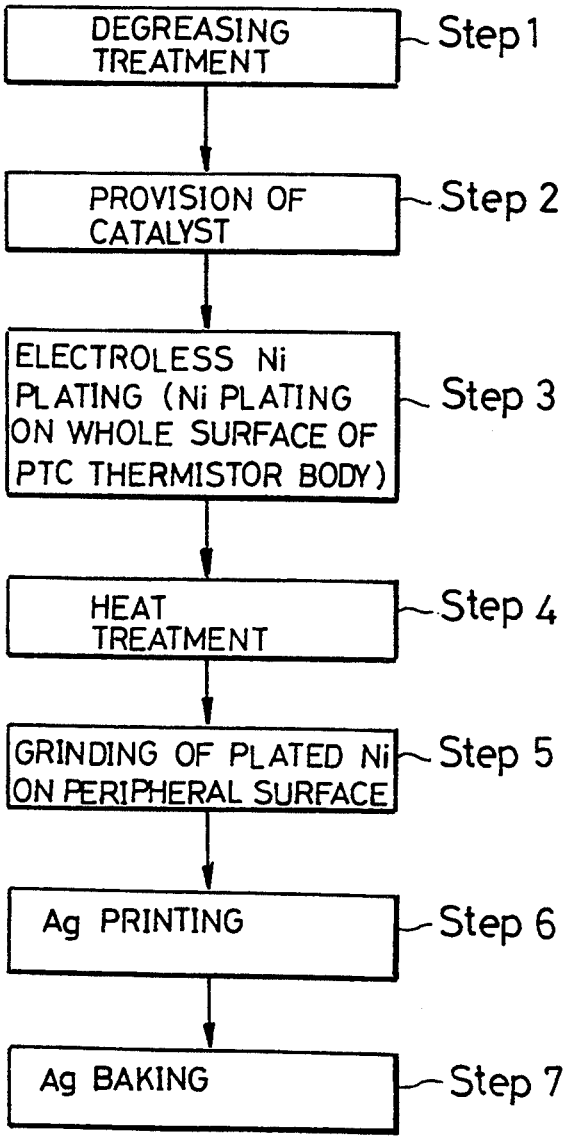
FIG. 2 is a flow chart showing formation of electrodes on a PTC thermistor body in a PTC thermistor according to the present invention.

Now, an example of formation of the electrodes on the PTC thermistor body will be described with reference to FIG. 2.

First, the PTC thermistor body 1 is subjected to a degreasing treatment (Step 1). More particularly, it is immersed in a degreasing agent which may be commercially available and then washed with water. Then, the PTC thermistor body 1 is immersed in a stannous chloride solution and then washed with water. Subsequently, the PTC thermistor body i is provided with a catalyst (Step 2). For this purpose, it is immersed in a palladium chloride solution and then washed with water. Then, the PTC thermistor body 1 is subjected to electroless Ni plating (Step 3). In Step 3, a plated layer or film of Ni-P alloy is deposited on a whole surface of the PTC thermistor body 1 by electroless plating, resulting in the first electrode 2*a* being formed on the PTC thermistor body 1. The PTC thermistor body 1 having the first electrode 2*a* thus formed thereon is then subjected to a heat treatment at 270° C. for one hour (Step 4) Then, the plated Ni layer on a side surface of the PTC thermistor body 1 is removed by grinding (Step 5). Thereafter, the second electrode 2*b* having a thickness of 3 to 7 μm is formed on the first electrode 2*a* by applying Ag paste on the first electrode 2*a* by printing while being positioned on an intermediate portion of the first electrode 2*a* to expose an outer end of the first electrode 2*a* by a distance or length of 1 to 2 mm, resulting in providing the first electrode 2*a* with exposed or uncovered end G as shown in FIG. 1 (Step 6). Finally, the Ag paste is subjected to baking at 500° C. for 10 minutes (S7) resulting in the electrodes 2 being completed.

The inventors made various kinds of tests on the PTC thermistor prepared according to the procedure described above with reference to FIG. 2. The tests were directed to ohmic properties, evaluation of craters, peeling strength and voltage properties of the PTC thermistor. Types 1 to 11 of PTC thermistors which are different in thickness of a Ni film and/or baking temperature of Ag from each other as shown in Table 2 were used for the tests. A plurality of the same specimens were prepared for each of Types 1 to 11.

TABLE 2

| TESTED PTC THERMISTORS | | |
|---|---|---|
| Types of PTC Thermistors | Thickness of Ni (μm) | Ag Baking Temp. (°C.) |
| 1 | 0.2 | 500 |
| 2 | 0.2 | 550 |
| 3 | 0.2 | 600 |
| 4 | 0.5 | 500 |
| 5 | 0.5 | 550 |
| 6 | 0.5 | 600 |
| 7 | 0.7 | 500 |
| 8 | 1.0 | 500 |
| 9 | 2.0 | 500 |
| 10 | 2.0 | 550 |
| 11 | 2.0 | 600 |

(1) Test on Ohmic Properties (Measurement of Resistance)

Resistance of each of Types 1 to 11 was measured at a room temperature or 25° C. The results were as shown in Table 3, wherein ∘ indicates an acceptable thermistor, X indicates an unacceptable thermistor and Δ indicates a thermistor of an intermediate level between the acceptable thermistor and the unacceptable thermistor.

TABLE 3

| TEST RESULTS ON OHMIC PROPERTIES | | |
|---|---|---|
| Types of PTC Thermistors | Resistance (Ω) | Evaluation |
| 1 | 4.8–5.0 | ∘ |
| 2 | 5.0–5.7 | Δ |
| 3 | 6.3–8.7 | x |
| 4 | 4.8–5.0 | ∘ |
| 5 | 4.9–5.5 | Δ |
| 6 | 5.3–6.5 | x |
| 7 | 4.8–5.0 | ∘ |
| 8 | 4.8–5.0 | ∘ |
| 9 | 4.8–5.0 | ∘ |
| 10 | 4.8–5.0 | ∘ |
| 11 | 4.9–5.1 | ∘ |

As can be seen from Table 3, there is observed a tendency that a decrease in thickness of the first electrode (Ni) 2*a* to a level of 0.5 μm or less causes resistance of the PTC thermistor to be increased when baking of the second electrode (Ag) 2*b* is carried out at a temperature of 550° C. or more. This would be for the reason that the glass component contained in the Ag paste diffuses through the first electrode (Ni) 2a into the PTC thermistor body 1, resulting in an insulating layer being formed in proximity to the surface of the PTC thermistor body 1, leading to an increase in resistance.

When a thickness of the first electrode (Ni) 2a is between 0.2 μm and 0.7 μm, baking of the second electrode (Ag) 2b at a temperature of 500° C. or below permits an acceptance ratio of the PTC thermistors to be increased.

Japanese Patent Application Laid-Open Publication No. 236602/1989 discloses that a plated Ni film of 0.7 μm or below in thickness fails to provide a PTC thermistor with satisfactory ohmic properties. This would be for the reason that baking of Ag is carried out at a temperature as high as 560° C.

In the above-described Japanese publication, the ohmic properties are evaluated by only ∘ and x. Unfortunately, a method for such evaluation is not made clear. Supposing that in the Japanese publication, evaluation of the ohmic properties was made on the basis of a resistance value as in the present invention, the conclusion in the Japanese publication that a Ni film of 0.7 μm or below in thickness fails to provide the PTC thermistor with satisfactory ohmic properties is unreasonable because it disregards the dependence on a baking temperature of the second electrode (Ag).

(2) Evaluation of Craters (Burst Marks or Traces)

Observation of craters produced on a surface of the uncovered end portion G of the first electrode (Ni) 2a on which the second electrode (Ag) is not formed were attempted and, as a result, the PTC thermistors of Types 1, 4, 7, 8 and 9 (a diameter of the PTC thermistor body: 18 mm, a thickness thereof: 2.5 mm) were graded depending on the number of craters produced. The evaluation was made on twenty (20) specimens for each of the types and craters which have a diameter of 0.2 mm or more were counted. The results were as shown in Table 4, wherein Grade A indicates that the average number of craters produced in the first electrode is less than 1, B indicates that it is 1 to 5, and C indicates that it is more than 5.

TABLE 4

EVALUATION OF CRATERS

| Types of PTC Thermistors | Average Number of Craters | Grade |
|---|---|---|
| 1 | 0 | A |
| 4 | 0 | A |
| 7 | 1.5 | B |
| 8 | 2.6 | B |
| 9 | 5.9 | C |

As can be seen from Table 4, the first electrode (Ni) 2a of 0.5 μm or less in thickness effectively prevents occurrence of craters in the first electrode (Types 1 and 4). The reason would be explained on the basis of a mechanism of occurrence of the craters. It would be considered that heat applied to the PTC thermistor during baking of the second electrode (Ag) 2b causes water which entered the PTC thermistor body 1 and then was collected at grain boundaries of the PTC thermistor body 1 or in possible voids of the body during the above-described catalyst providing step or the above-described plating treatment to burst due to thermal expansion, resulting in craters being produced in the first electrode. The reason why Types 7, 8 and 9 fail to prevent occurrence of the craters is that these types provide the first electrode (Ni) 2a in the form of a continuous and dense film to a degree sufficient to prevent the water from being outwardly discharged through the first electrode under the conditions of the heat treatment (270° C., 1 hour) after the Ni plating. This is referred to as "sealing action of Ni film" herein.

Figure 3:
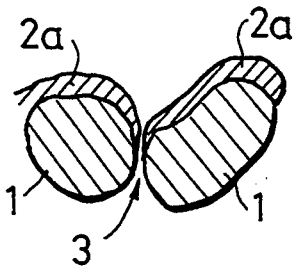
FIGS. 3 to 5 each are a schematic view showing a sealing action of a Ni film which is a first electrode.
Figure 4:
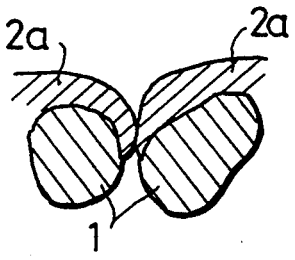
Figure 5:
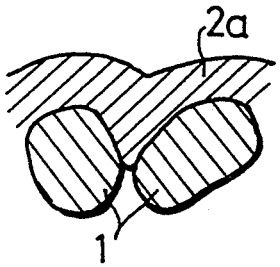

The sealing action of the Ni film is shown in FIGS. 3 to 5, which indicate that the sealing effect of the Ni film depends on a thickness of the plated Ni film. FIGS. 3 to 5 show the sealing effect of the Ni film or first electrode when a thickness of the Ni film is 0.5 μm, 1.0 μm and 2.0 μm, respectively. The first electrode (Ni) 2a of 0.5 um or less in thickness causes slight interstices which exist at the Ni film in proximity to the grain boundaries of the PTC thermistor body 1 as shown in FIG. 3 to restrain the sealing effect of the Ni film, resulting in water remaining in the PTC thermistor body 1 being readily outwardly discharged. On the contrary, the thickness of 1.0 μm (FIG. 4) or 2.0 μm (FIG. 5) causes the Ni film to exhibit the sealing action which prevents water remaining in the PTC thermistor body 1 from being outwardly discharged through the Ni film, so that the craters may be readily produced.

(3) Peeling Strength

Peeling strength was measured on Types 1, 4, 7, 8 and 9. For this purpose, a lead wire of 0.5 mm in diameter was mounted on the second electrode (Ag) 2b by soldering in a manner to be parallel to a surface of the electrodes 2. Then, the lead wire is vertically stretched with respect to a surface of the PTC thermistor body 1, so that force which causes the lead wire to be peeled from the electrode was measured. The results were as shown in Table 5.

TABLE 5

| Types of PTC Thermistors | Tensile Strength (kgf) | Main Peeling Mode |
|---|---|---|
| 1 | $\bar{x}$ = 2.5 | Peeling between Body and Ni |
| 4 | 2.3 | Peeling between Body and Ni |
| 7 | 2.0 | Peeling between Body and Ni |
| 8 | 1.7 | Peeling between Body and Ni |
| 9 | 1.2 | Peeling between Ni and Ag |

Table 5 indicates that the first electrode of 2.0 μm (Type 9) in thickness causes the tensile strength to be decreased and the peeling to be carried out between the first electrode (Ni) 2a and the second electrode (Ag) 2b. This would be for the reason that an increase in thickness of the first electrode (Ni) 2a causes a surface of the first electrode (Ni) 2a to be rounded, to thereby reduce unevenness on the surface. Also, it would be considered that the more a thickness of the first electrode (Ni) 2a is reduced, the more unevenness on the surface of the first electrode is increased; so that an area of contact between the Ni electrode and the Ag electrode may be increased, leading to an increase in peeling strength.

(4) Voltage Application Test

Various load tests including an intermittent load test at a normal temperature, a continuous load test at an elevated temperature and an intermittent load test in a wet atmosphere while keeping a thickness of the first electrode (Ni) reduced were carried out on the PTC thermistors of Types 1, 4, 8 and 9 and then a rate of change of initial resistance value of each of the thermistors was measured. The results were as shown in Table 6. The intermittent load test at a normal temperature was carried out in 1000 cycles at a normal temperature, a normal humidity, an AC voltage of 180 V, load resistance of 12Ω and a cycle wherein ON is kept for one minute and OFF is kept for five minutes. The Continuous load test at an elevated temperature was carried out at a temperature of 150°±2° C., an AC voltage of 180 V and load resistance of 12Ω for 2000 hours. The intermittent load test in a wet atmosphere was carried out in 1000 cycles at a temperature of 40°±2° C., a relative humidity of 90 to 95%, an AC voltage of 180 V, load resistance of 12Ω and a cycle wherein ON is kept for 30 minutes and OFF is kept for 90 minutes. The results were as shown in Table 6.

TABLE 6

| Types of PTC Thermistors | Test 1 | Test 2 | Test 3 |
|---|---|---|---|
| 1 | +2.1~3.2 | −0.2~4.4 | 1.2~2.0 |
| 4 | +1.9~3.2 | 0.3~4.0 | 0.5~1.9 |
| 8 | +1.6~2.8 | 1.0~3.8 | 1.3~2.7 |
| 9 | +1.8~3.5 | 0.7~4.0 | 0.6~1.3 |

Table 6 indicates that there was not substantially established any correlation between a rate of change of an initial resistance value of each of the thermistors and a thickness of the first electrode (Ni) 2*a*. Thus, it was confirmed that the PTC thermistor of the present invention exhibits substantially the same reliability in serviceability as the conventional one in which the thickness is 2.0 μm, even when a thickness of the first electrode (Ni) 2*a* is between 0.2 μm and 0.7 μm.

Figure 6:
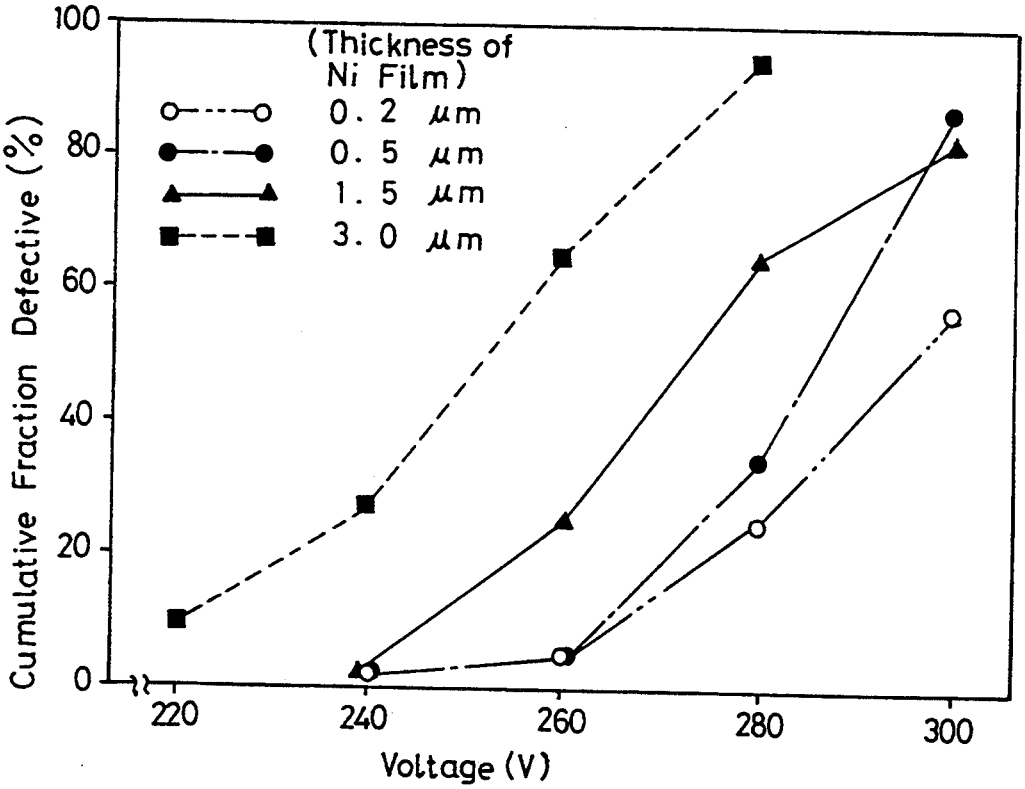
FIG. 6 is a graphical representation showing results of a crack resistance test.

Further, another voltage application test or a crack resistance test was carried out in order to determine relationships between a thickness of the first electrode (plated Ni film) and resistance to cracking of the first electrode. For this purpose, four kinds of PTC thermistors were used in the test. 40 specimens were prepared for each of four kinds of thermistors. The test was carried out in 30 cycles at load resistance of 12Ω, an AC voltage of 220 to 300 V and a cycle wherein ON is kept for 6 seconds and OFF is kept for 294 seconds. The results were as shown in FIG. 6. Breaking modes seen in the test each were a lameliar crack.

As can be seen from FIG. 6, a decrease in thickness of the Ni film permits a rate of failure of the PTC thermistor by a crack resistance test to be reduced. The crack resistance test is typically carried out with respect to a product which is increased in inrush voltage, such as an element for starting a motor. One of reasons why a decrease in thickness of the Ni film contributes to an improvement in resistance to cracking would be that the decrease in thickness causes an internal stress of the Ni film to be reduced, to thereby restrain a decrease in strength of the PTC thermistor body. Another reason would be that an increase in occurrence of the craters leads to an increase in damage to the electrode, resulting in a current distribution being rendered non-uniform during the voltage application in the crack resistance test, to thereby easily cause cracking.

Thus, the above-described tests indicate that the PTC thermistor of the present invention exhibits a lot of advantages.

More particularly, the results of evaluation of the craters indicate that the PTC thermistor of the present invention effectively prevents occurrence of the craters after baking of the second electrode (Ag), to thereby ensure a good appearance of the PTC thermistor to increase yields of the PTC thermistor. Also, the present invention is so constructed that the first electrode (Ni) 2*a* is decreased in thickness to a level of 0.7 μm or less. Such construction permits a period of time required for the plating to be one third to one tenth as long as that in the conventional PTC thermistor, permits the plating to be carried out with high efficiency and permits the manufacturing cost to be reduced. Further, the PTC thermistor of the present invention passes the Ni peeling test and is increased in peeling strength of the lead wire.

As can be seen from the foregoing, the PTC thermistor of the present invention is constructed in the manner that the first electrode is formed into a thickness as small as 0.2 to 0.7 μm, so that water such as a Ni plating solution or the like entering the PTC thermistor body may be readily outwardly discharged during baking of the second electrode to substantially prevent occurrence of craters in the first electrode. Such construction ensures satisfactory ohmic contact between the PTC thermistor body and the electrodes and prevents deterioration in appearance of the thermistor to increase the yields. Also, in the present invention, the heat treatment is carried out at a temperature of 500° C. or less, to thereby improve the ohmic properties.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

We claim:

1. A PTC thermistor comprising:

a PTC thermistor body;

a first electrode plated onto said PTC thermistor body and comprising Ni having a thickness of 0.2 to 0.7 μm; and a second electrode arranged on said first electrode and primarily comprising Ag, thereby having a low contact resistance.

2. A PTC thermistor as defined in claim 1, wherein said second electrode is formed by baking carried out at a temperature of 500° C. or less.

3. A PTC thermistor as defined in claim 2, wherein said second electrode comprises a composition of Ag powder and frit selected from the group consisting of lead borosilicate glass and soda-lime glass.

4. A process for manufacturing a PTC thermistor comprising the steps of:

providing a PTC thermistor body;

plating Ni to a thickness of 0.2 to 0.7 μm on a surface of said PTC thermistor body to form a first electrode thereon; and depositing metal of low contact resistance on said first electrode to form a second electrode thereon.

5. A process as defined in claim 4, further comprising the step of providing said PTC thermistor body with a catalyst prior to the Ni plating step.

6. A process as defined in claim 4, further comprising the step of heat treating said PTC thermistor body after said plating of Ni on said PTC thermistor body.

7. A process as defined in claim 4, wherein said plating of Ni on said PTC thermistor body is carried out on the entire surface of said PTC thermistor body.

8. A process as defined in claim 7, including removing said Ni plated on a peripheral surface of said PTC thermistor body prior to said depositing of said metal of low contact resistance.

9. A process as defined in claim 4, wherein said depositing of said second electrode on said first electrode comprises printing Ag paste onto said first electrode.

10. A process as defined in claim 9, further comprising the step of baking said Ag paste.

11. A process as defined in claim 10, wherein said baking is carried out at a temperature of 500° C. or less.

* * * * *

UNITED STATES PATENT AND TRADEMARK OFFICE

CERTIFICATE OF CORRECTION

PATENT NO. : 5,337,038

DATED : August 9, 1994

INVENTOR(S) : Taniguchi *et al.*

It is certified that error appears in the above-identified patent and that said Letters Patent is hereby corrected as shown below:

Column 1, line 41, delete ":" and insert therefor --.--.
Column 7, line 44, "lameliar" should read --lamillar--.

Signed and Sealed this

Eleventh Day of October, 1994

*Attest:*

*Attesting Officer*

Bruce Lehman

BRUCE LEHMAN

*Commissioner of Patents and Trademarks*